United States Patent [19]

McGinley

[11] Patent Number: 4,887,650

[45] Date of Patent: Dec. 19, 1989

[54] BEAT-UP MECHANISM FOR WEAVING LOOMS

[76] Inventor: Thomas F. McGinley, 903 N. 32nd St., Allentown, Pa. 18104

[21] Appl. No.: 263,269

[22] Filed: Oct. 27, 1988

[51] Int. Cl.[4] ..... D03D 41/00

[52] U.S. Cl. ..... 139/460; 139/188 R

[58] Field of Search ..... 139/11 R, 11 A, 188 R, 139/192

[56] References Cited

U.S. PATENT DOCUMENTS

| | | | |
|---|---|---|---|
| 759,317 | 5/1904 | Saurer . | |
| 1,067,619 | 7/1913 | Moriggi . | |
| 2,231,126 | 2/1941 | Kinsella | 139/192 |
| 3,590,880 | 7/1969 | Kathriner . | |
| 3,799,209 | 3/1974 | Dow et al. . | |
| 4,122,871 | 10/1978 | McGinley . | |
| 4,351,367 | 9/1982 | McGinley . | |
| 4,655,259 | 4/1987 | Steiner | 139/11 A |

FOREIGN PATENT DOCUMENTS

| | | | |
|---|---|---|---|
| 2138034 | 10/1984 | United Kingdom | 139/192 |

*Primary Examiner*—Henry S. Jaudon

*Attorney, Agent, or Firm*—Bell, Seltzer, Park & Gibson

[57] ABSTRACT

A beat-up mechanism for a weaving loom includes a relatively movable indexing reed and beat-up reed adjacent each other and arranged to transport weft threads adjacent the fell of the fabric and then beat-up the weft threads into the fell by means of beat-up fingers inserted between warp threads. The indexing and beat-up reeds each are constructed as modular units and include multiple, parallel fingers having narrow tip portions and wider root portions, whereby the wider root portions of one reed maintain the warp threads spaced apart for insertion of the tip portions of the other reed during weft transfer. The indexing and beat-up reeds are particularly useful in a multi-shed weaving loom wherein multiple sheds are progressively moved toward the fell of the fabric during the weaving operation with insertion of a pick in each shed. The indexing and beat-up reeds, moreover, include a guiding arrangement whereby the reeds are positively maintained in lateral alignment during weft transfer and beat-up.

19 Claims, 6 Drawing Sheets

BEAT-UP MECHANISM FOR WEAVING LOOMS

FIELD OF THE INVENTION

The present invention relates to an apparatus employed in multi-shed weaving looms, in particular, an improved beat-up apparatus that continuously maintains the spacing between warp theads while beating up weft thread into the fell of the fabric.

DESCRIPTION OF THE RELATED ART

Weaving looms of the multiple movable warp shed type are known in the art. In this type of loom, after a weft thread is inserted into one of the multiple moving sheds formed in the warp threads, the weft thread is moved toward the cloth fell as usual and is eventually beat-up into the fell of the fabric. A mechanism for beating up the weft thread in a multi-shed loom is described in U.S. Pat. No. 4,351,367 granted Sept. 28, 1982.

In one prior art embodiment the beat-up mechanism in a multi-shed loom is formed as part of a shed retaining member and is carried by a conveyor toward the fell of the fabric. The beat-up mechanism advances the weft thread towards the fell of the fabric and operates to beat up the weft thread into the fell. The beat up element is then withdrawn from the warp threads to be returned along the lower run of the conveyor along with the shed retaining mechanism to repeat another cycle. In such arrangements, the number of beat-up elements extending transversely across the loom corresponds to the number of shed retaining members and is very large. The beat-up elements and retaining members must be closely spaced in order to retain the sheds and beat up the weft thread. Because of the large number of beat up elements and their close spacing, as they are moved in the direction of the warp thread towards the fell, friction is produced between the beat up elements and the warp threads. The friction produced increases the likelihood of one of the warp threads breaking.

In another embodiment, the conveyor of a multi-shed weaving mechanism carries a plurality of weft advancing arms which advance the inserted weft thread toward the fell of the fabric. The weft advancing arms push the weft thread into a rotating reed member, and the weft advancing arms are withdrawn from between the wrap threads and returned along the lower run of the conveyor to repeat another cycle. The reed member rotates to beat up the weft threads into the fell of the fabric. The rotating reed member continuously rotates against the warp threads at the fell of the fabric and thereby causes undesired friction on the warp threads. As stated above, this friction increases the likelihood of the warp thread breaking.

The beat-up system of U.S. Pat. No. 4,351,367 provided a beat-up mechanism which reduced the friction on the warp threads and operated to continuously maintain a spacing between the warp threads while the weft threads were beat-up into the fell of the fabric. The beat-up mechanism consisted of two parts, with at least one part of the two part beat up mechanism always inserted in a position between the warp threads to continuously maintain the spacing of the warp threads.

However, the accuracy of the operation of the beat-up mechanism as described in U.S. Pat. No. 4,351,367 depended on the accurate registration and alignment of the index reed and the beat-up reed. The two components of the warp wave beat-up system cooperated in transferring the warp threads from one component to the other. But when the teeth or finger elements of one component are not correctly aligned with the corresponding teeth or finger elements of the other component, it is possible for warp threads to be transferred to an incorrect space in the beat-up system.

Accordingly, it is an object of the present invention to provide an improved apparatus which overcomes the aforesaid problems of warp thread friction and misalignment. Specifically, it is an object of the present invention to provide an improved index reed and beat-up reed comprising teeth or finger elements of varying transverse thickness. The change in thickness of both beat-up components is so arranged as to effectively prevent transfer of the warp threads from one space between the finger elements to another even when the teeth or finger elements are not in perfect alignment.

It is a further object of the present invention to provide in the blocks holding the teeth or finger elements, corresponding guide pins and openings. The pin and opening feature of the present invention is a cooperating interlocking feature that allows constant mutual contact and registration between the index reed and the beat-up reed throughout their motion relative to each other during the beat-up operation of the mechanism and is effective to prevent the transfer of warp threads from one finger spacing to another during beat-up operation.

SUMMARY OF THE INVENTION

In accordance with the objects of the present invention, an improvement is provided over the beat-up system disclosed in U.S. Pat. No. 4,351,367 which is incorporated herein by reference for its general description of the operating environment of and actuating system for the present invention. The present invention comprises a plurality of indexing fingers disposed between the end of the weft guide conveyor and the fell of the fabric and movable into and out of a position between the warp threads for maintaining the proper spacing between the warp threads. In addition, a plurality of beat-up fingers cooperate with the indexing fingers and are also movable into and out of a position between the warp threads and operate to beat-up the weft threads into the fell of the fabric and also operate to maintain the spacing of the warp threads when the indexing fingers are withdrawn from the warp threads. The index and beat-up fingers each have a thicker root section than the tip section (at least widthwise across the fingers) with a transition section between the root and tip.

In accordance with the present invention, before the indexing fingers are withdrawn from between the warp threads, the beat-up fingers are inserted between the warp threads to an extent that the thinner tip sections of the beat-up fingers are inserted between the warp threads. The beat-up fingers of this invention then maintain the spacing between the warp threads. The indexing fingers are then withdrawn and the beat-up fingers operate to beat-up the weft threads into the fell of the fabric. After the beat-up operation is completed, the narrower tips of the indexing fingers are reinserted between the warp threads which are now separated to a greater degree than normal by the wider root sections of the beat-up fingers. The beat-up fingers are then withdrawn so that the subsequent weft thread can be engaged and moved forward towards the fell of the fabric.

In accordance with the present invention, there is also provided a guide feature for maintaining mutual contact between the indexing reed and the beat-up reed throughout the beat-up operation. The guide feature preferably comprises at least one guide pin fixed to either of the indexing reed or beat-up reed and which is in continuous sliding engagement with a guide opening in the other of the indexing reed or beat-up reed. The continuous sliding engagement between the guide pin and guide opening of the corresponding indexing and beat-up reed ensures the continuous alignment of the indexing fingers and the beat-up fingers. The mutual contact between the guide pin and guide opening ensures that the warp threads are not transferred to an incorrect space between the fingers of the beat-up system due to improper positioning of the beat up fingers.

The invention also contemplates a modular construction of indexing and beat-up fingers.

BRIEF DESCRIPTION OF THE DRAWINGS

Further objects, features, and advantages of the present invention will become apparent upon the consideration of the following detailed description of the preferred embodiment of the invention when taken in conjunction with the accompanying drawings wherein.

DETAILED DESCRIPTION OF THE PREFERRED EMBODIMENT

The present invention is an improvement over the beat-up system disclosed in U.S. Pat. No. 4,351,367 incorporated herein by reference. A weaving machine embodying the general principles of operation of the present invention and comprising a conveyor, a shed forming mechanism, a beat-up mechanism (FIGS. 6–11) over which the present invention constitutes an improvement, and associated operating systems are all disclosed in the aforesaid patent and will not be described in detail herein.

Figure 1:
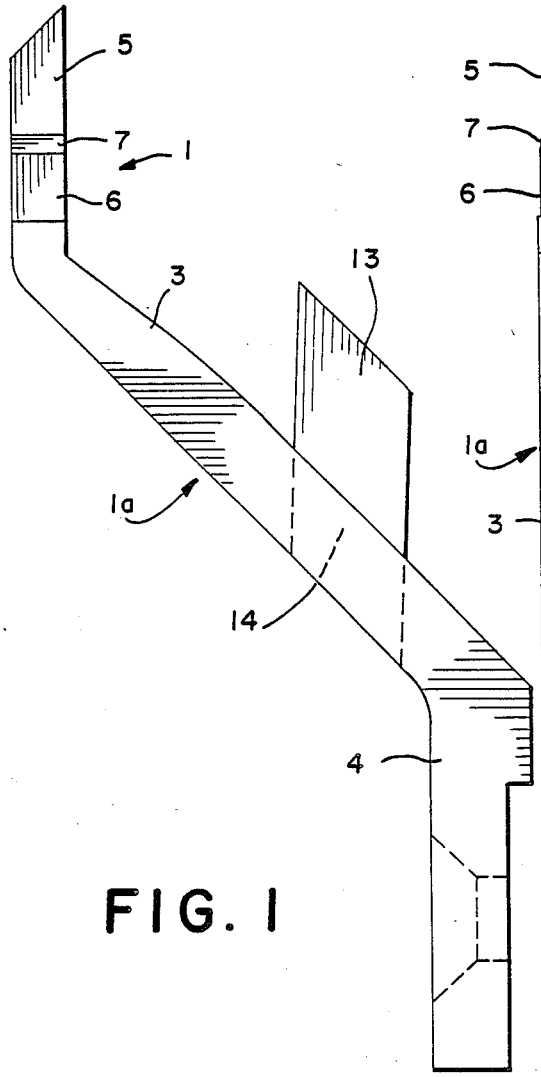
FIG. 1 is a side elevational view of a section of the beat-up reed embodying the present invention.
Figure 2:
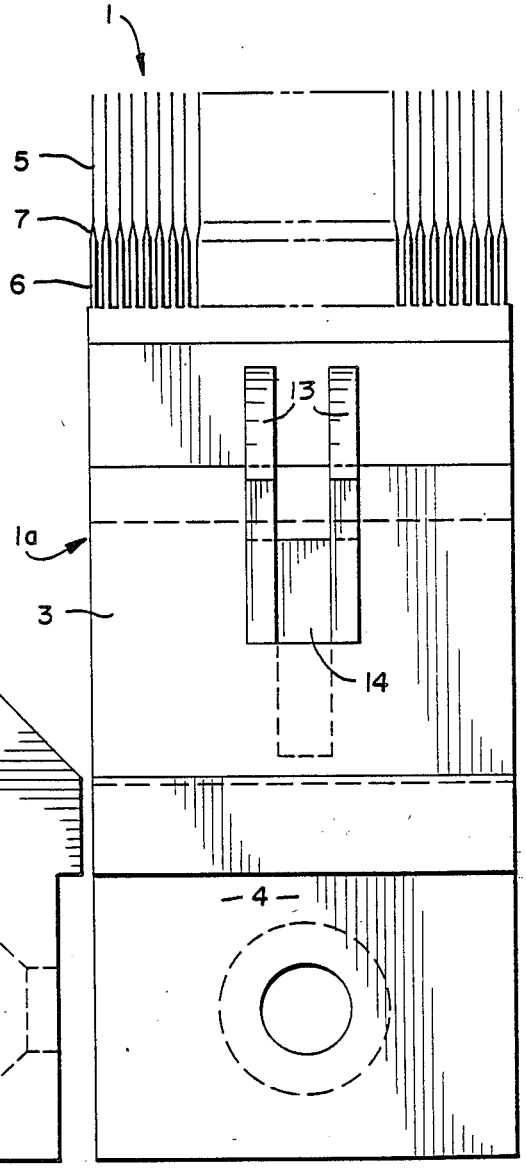
FIG. 2 is a front elevational view of a section of the beat-up reed embodying the present invention.
Figure 3:
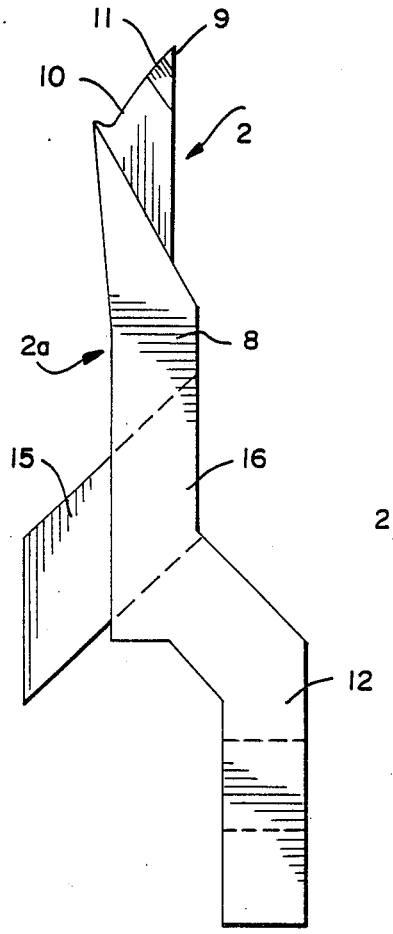
FIG. 3 is a side elevational view of a section of the indexing reed embodying the present invention.
Figure 4:
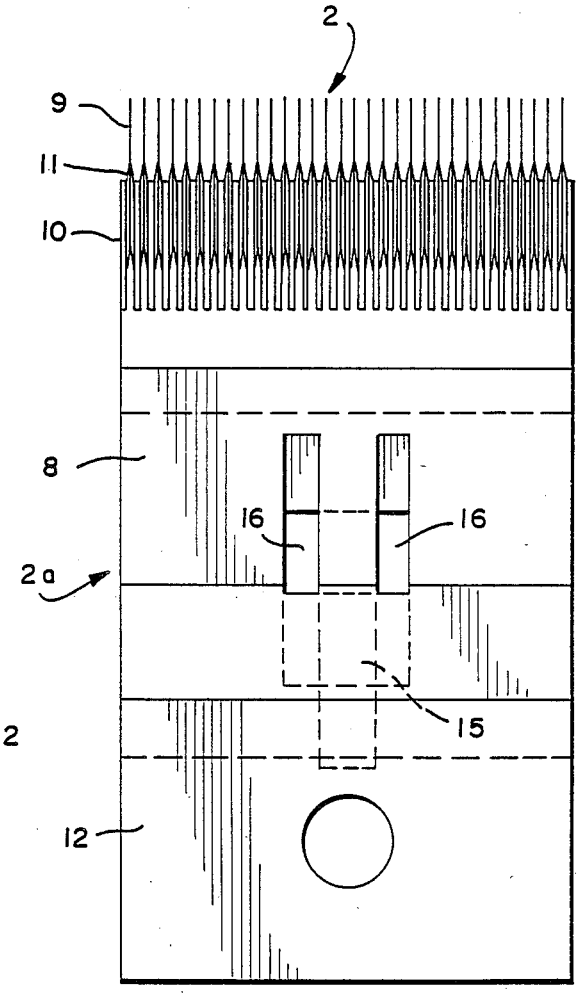
FIG. 4 is a front elevational view of a section of the indexing reed embodying the present invention.
Figure 5:
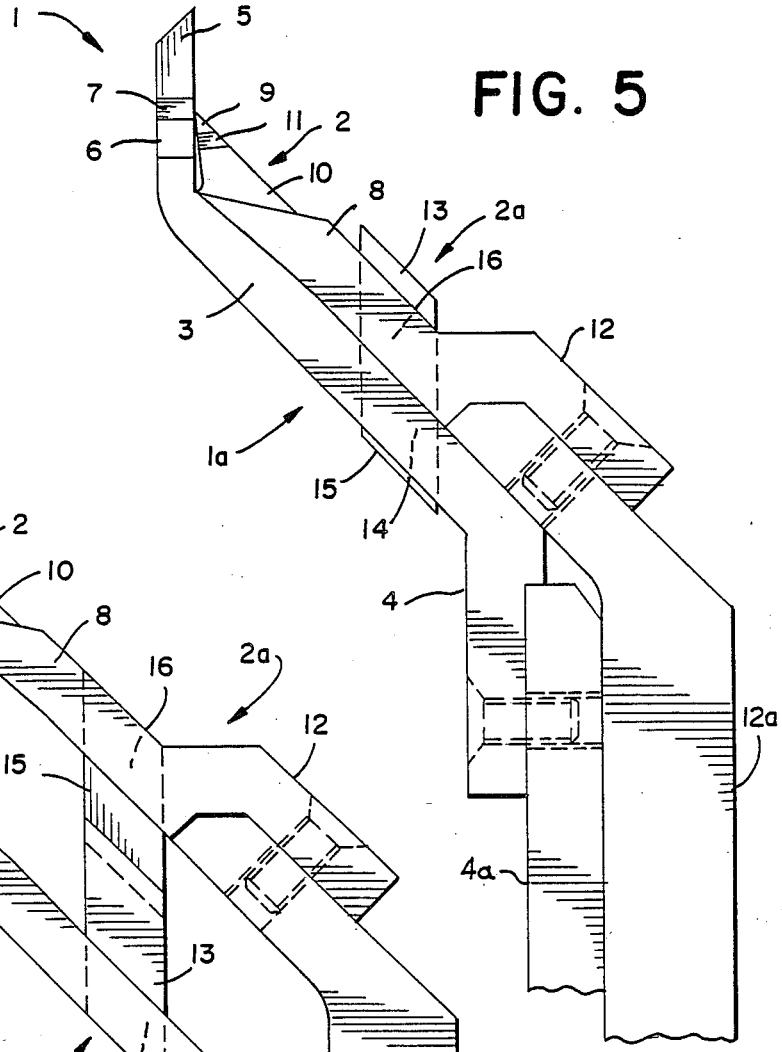
FIG. 5 is a side elevational view of both the indexing reed and the beat-up reed relatively positioned for beating up a weft thread.
Figure 6:
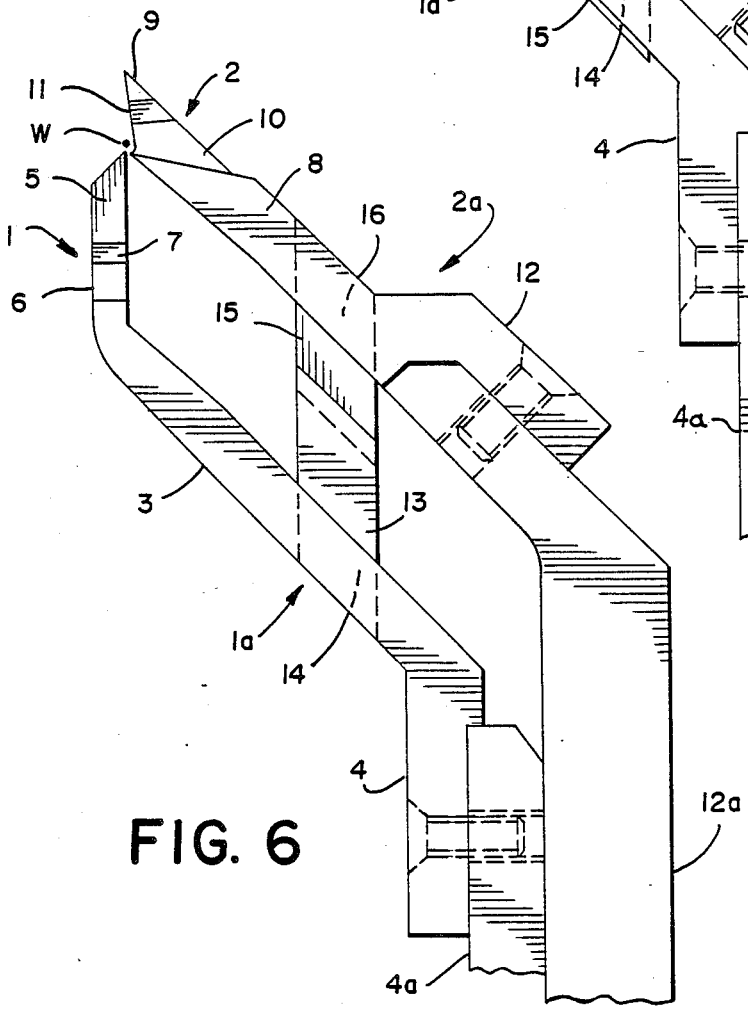
FIG. 6 is a side elevational view of the indexing reed and the beat-up reed relatively positioned for engaging a subsequent weft thread to be moved to the beat-up position.

Referring now to FIGS. 1–6, the improved beat-up mechanism of the present invention is more clearly illustrated. As shown in FIGS. 2 and 4, the beat-up mechanism consists of a plurality of beat-up fingers 1 and a plurality of indexing fingers 2 which extend across the width of the loom and are adapted to be inserted between longitudinally extending warp threads (see FIGS. 10–15). These fingers 1, 2 cooperate with each other to maintain the proper spacing between the warp threads while beating up the weft threads W into the fell F of the fabric, all as described in U.S. Pat. No. 4,351,367 in respect of the embodiment shown in FIGS. 6–11 of the patent. In FIG. 6 the weft thread w is illustrated at its position relative to the indexing and best up fingers.

As specifically shown in FIGS. 1 and 2, the beat-up reed la comprises a series of cantilevered fingers 1 extending parallel from a modular base portion 3 of the beat-up reed towards the warp sheet. The beat-up reed la also includes a connecting portion 4 for connecting the reed to a means **4*a* for imparting motion to the reed as described in U.S. Pat. No. 4,351,367 and not further described herein. The fingers 1 of the beat-up reed 1*a* are divided into two sections of different transverse widths. The distal or tip sections 5 of the fingers have a smaller width than the root sections 6 which connect the fingers to the base 3 of the beat-up reed. A transition portion 7 forms a continuous surface connecting the wider root section 6 with the narrower tip section 5** so as not to interfere with sliding contact of the warp threads along the length of the fingers.

The indexing reed **2*a* (FIGS. 3 and 4) also comprises a series of cantilevered parallel fingers 2 extending from the modular base 8 of the indexing reed. The indexing fingers 2 include two sections of different widths, with the distal or tip sections 9 having a narrower width than the root sections 10 which connect the indexing fingers to the indexing base portion 8. An indexing finger transition portion 11 forms a continuous surface connecting the tip sections 9 with the root sections 10 of the fingers 2. The continuous transition surface 11 permits the fingers to be smoothly inserted between and retracted from the warp threads. The indexing reed 2*a* also includes a connecting portion 12 for connection to the motion imparting means 12*a***.

It will be noted that the index and beat-up fingers are constructed as modular units, as best seen in FIGS. 2 and 4. That is, the connecting portions 4 and 12 are arranged to be secured by suitable fastening means as illustrated in FIGS. 5 and 6 to the motion imparting elements **4*a* and 12*a* connected to a loom driving mechanism. The motion imparting means 4*a*, 12*a*** for example, may extend continuously along the loom width, with modular sections of the indexing and beat-up portions secured thereto by suitable fasteners. The modular construction enables repairs and replacement of discreet sections of indexing and beat-up reed portions without replacing the entire indexing and beat-up reed systems.

Figure 7:
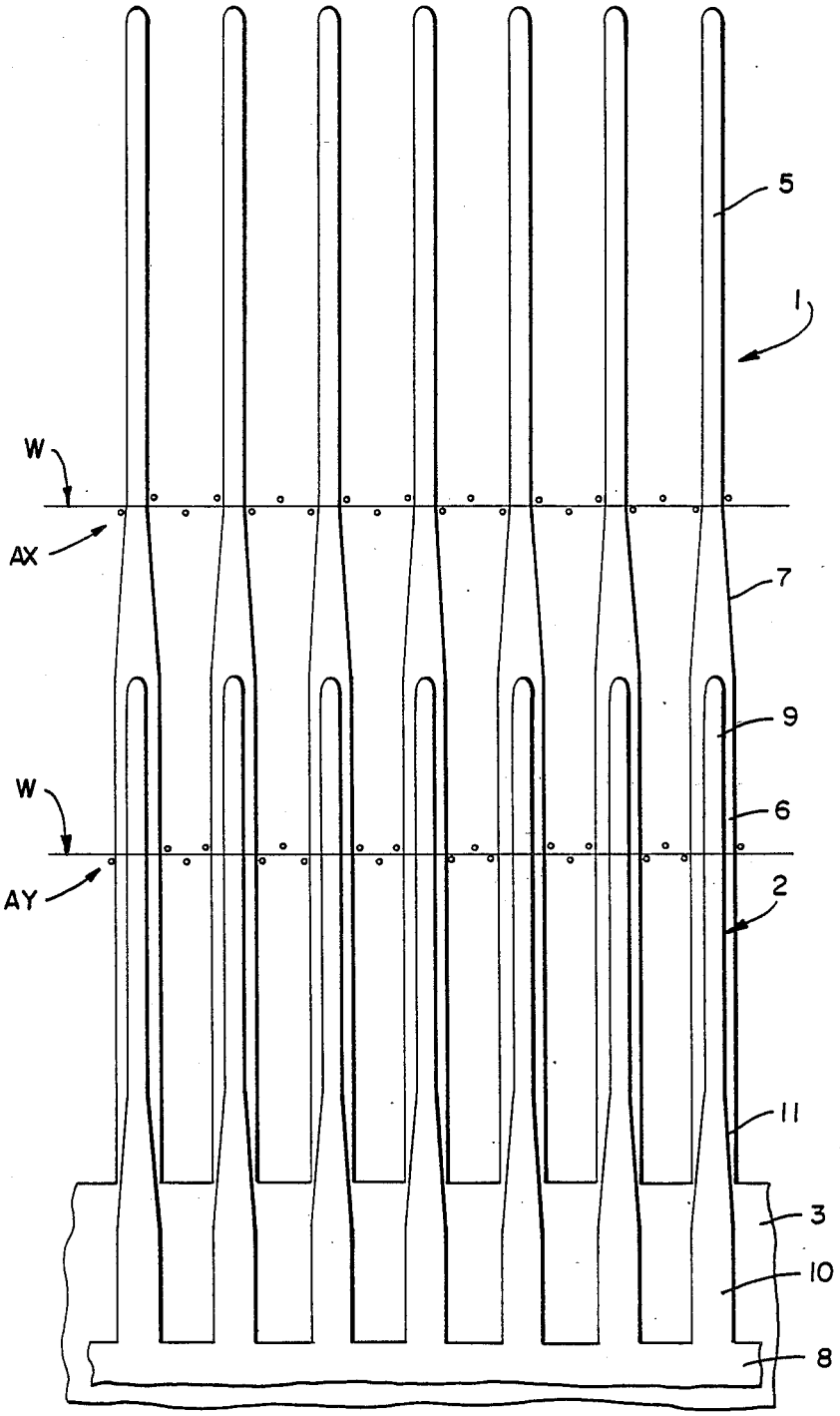
FIG. 7 is a front elevational view showing the alignment between the fingers of the indexing reed and the beat-up reed and the thicker cross-sectional sections of the fingers of both reeds.
Figure 11:
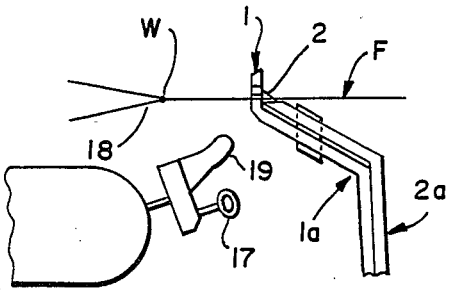

FIG. 7 illustrates the relative thicknesses between the two section of the fingers of the beat-up and indexing reeds and shows the positions of the warp sheet at beat-up (AX) and when the indexing fingers and beat-up fingers are at their highest position (AY) as shown at FIG. 11. As an be seen from this figure, when the beat-up fingers 1 are extended through the warp threads of a shed to the extent that the warp threads of the shed are spaced apart by the wider root sections 6 of the beat-up fingers, the tips 9 of the indexing fingers 2 can be easily inserted in the spacing provided by the wider finger sections 6 of the beat-up reed even though the fingers may be not perfectly aligned. The indexing fingers 2 will be extended at times through the warp threads to the extent that the warp threads are spaced apart by the wider root portions 10. When the wider portions 10 separate the warp threads, the fingers of the beat-up reed 1 can be easily withdrawn and reinserted between the spacings maintained by the wider root portions 10 of the indexing fingers. It can be easily seen from FIG. 7 that even when the beat-up and the indexing fingers of the two reeds are not in perfect alignment, the narrow tips of one set of reed fingers can be easily inserted in the larger spaces provided in the warp threads by the wider root sections of the other reed fingers. In this manner, the beat-up fingers 1 and the indexing fingers 2 cooperate to continuously maintain the spacing of the warp threads.

In addition to the improved beat up fingers 1 and indexing fingers 2, the present invention includes a means for maintaining mutual contact between the beat-up reed 1*a* and the indexing reed 2*a* in order to continuously maintain the spacing of the warp threads. This means for maintaining continuous mutual contact includes a guide pin means and guide opening means on the base portions of both the beat-up reed 1*a* and the indexing reed 2*a*.

FIGS. 1–6, 8 and 9 show a preferred embodiment of the means for maintaining mutual contact between the beat-up reed 1*a* and the indexing reed 2*a*. Specifically, FIGS. 1 and 2 show guide pin means 13 which extend from the base portion 3 of the beat-up reed 1*a* toward the indexing reed 2*a*, and a guide opening means 14 extending through the base portion 3 of the beat-up reed 1*a*. FIGS. 3 and 4 show guide pin 15 which extends from the base portion 8 of the indexing reed 2*a* in a direction toward the beat-up reed 1*a*, and guide openings 16 which extend through the base portion 8 of the indexing reed 2*a*. As seen in FIGS. 5 and 6, the guide pin means and guide opening means of the respective beat-up and indexing reeds extend in parallel directions.

FIG. 5 shows the closest relative positions occupied by the beat-up reed and the indexing reed 2*a* during the beat-up operation of the present invention. In FIG. 5, the pin means 13 of the beat-up reed engage the openings 16 of the indexing reed, and the pins means 15 of the indexing reed engages the opening 14 of the beat-up reed. In this manner, mutual contact and alignment of the reed sections and the respective fingers of the beat-up reed and indexing reed are maintained by an interlocking relationship.

Figure 8:
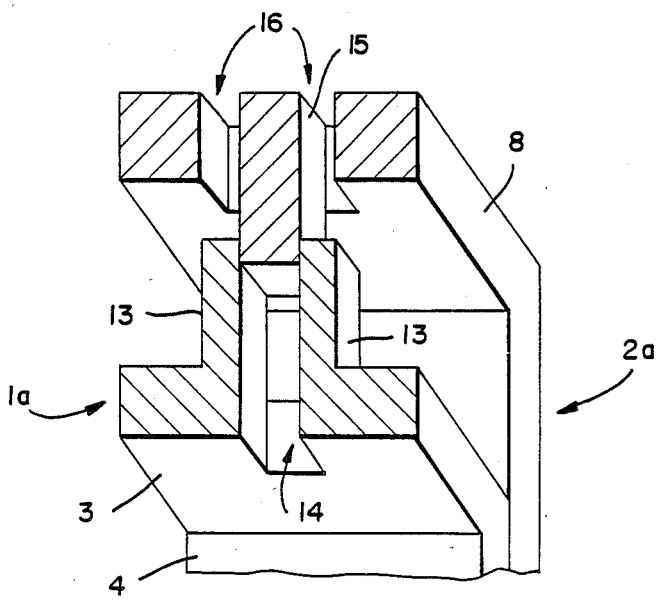
FIGS. 8 and 9 show partial sectional views of the improved guide pin and guide opening feature for maintaining mutual contact between the indexing reed and the beat-up reed during the beat-up operation.
Figure 9:
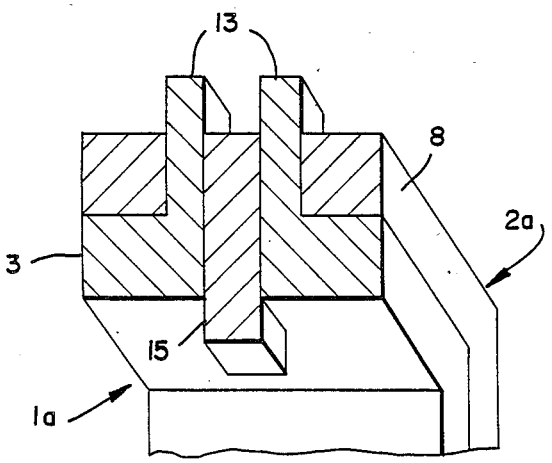

FIG. 6 shows the relative position between the beat-up reed 1a and the indexing reed 2*a* when they are moved to their furthest extent from each other during the beat-up operation of the mechanism. As seen in the figure, mutual contact between the reeds is maintained by the overlapping engagement of the respective guide pins means of the beat-up reed 13 and the indexing reed 15. The overlapping relationship between the guide pin means, and the engagement of the pin and the guide opening of the respective beat-up and indexing reeds are best seen in FIGS. 8 and 9, respectively. As seen in FIG. 8, mutual contact between the reeds is maintained by the contact between the pins 13 of the beat-up reed with the pin 15 of the indexing reed which are rectangular in cross section in the preferred embodiment. Even when the reeds are moved to their furthest extent from each other, the mutual contact is maintained (FIG. 8). Also in FIGS. 8 and 9, the relative positions between the pins means 13 and opening 14 of the beat-up reed, and the respective positions of the pin means 15 and openings 16 of the indexing reed can best be seen. The beat-up reed and indexing reed move relative to each other but maintain mutual contact during the sequence of operations involved in the beat-up of a weft thread. The sequence of operations involved in beating up the weft thread are shown in FIGS. 10–15. It should be noted that, for some applications a single guide pin in either the indexing or beat-up reed and a cooperating guide opening in the other red will suffice to provide the desired guiding contact.

Figure 10:
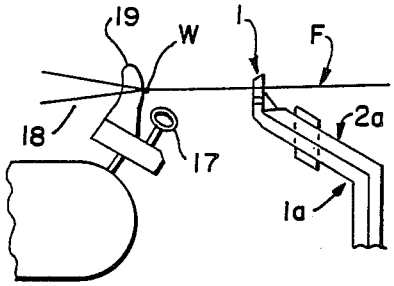
FIGS. 10–15 illustrate in sequence the operation of the improved beat-up apparatus in accordance with the present invention.

In FIG. 10, the previous cycle for beating up the weft thread into the fell of the fabric F has just been completed, and the cycle for beating up the subsequent weft thread W is about to begin. The shed retainers 17 have been rotated to their shed disengaging positions and retracted from between the lower warp threads 18. At this stage of the loom operation, the spacing between adjacent warp threads at the fell of the fabric F is maintained by the tip sections of the beat-up fingers 1. As the shed retainers 17 are retracted from between the lower warp thread 18, and the weft thread advancing means 19 moves a subsequent weft thread W into a beat-up position (FIG. 10), the spacing between adjacent warp threads is maintained by the beat-up reed fingers 1, and the series of movements of the beat-up system to beat-up the subsequent weft thread W just removed from the shed retainers 17 begins.

Figure 12:
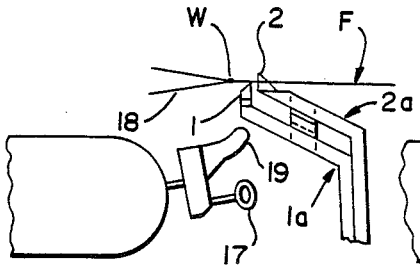
Figure 13:
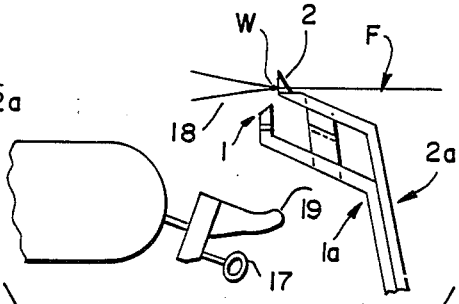
Figure 14:
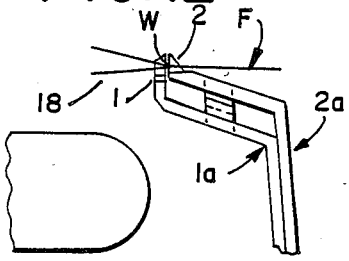

Initially, the beat-up reed 1*a* and the indexing reed 2*a* moves as a unit first backwards (towards the inserted weft) and then in an upward direction to insert the tips of the indexing reed 2 in the space between the warp threads which at this point are spaced by the wide root portions 6 of the beat-up reed 1 (FIG. 11). As the indexing reed fingers 2 project through the spaces between adjacent warp threads maintained by the beat-up reed fingers 1, the beat-up reed 1*a* begins to move in downward direction relative to the indexing reed 2*a*. As the beat-up reed 1*a* is moved downward and retracted from the plane of the fabric, the beat-up reed and the indexing reed move as a unit to the left (i.e., rearwards) as shown in FIGS. 12 and 13, toward the weft thread W most recently removed from the shed retainers 17. At the furthest extent of the leftward movement of the beat-up reed and the indexing reed, the indexing reed fingers 2 just contact the recently removed weft thread W along the entire length of the indexing reed 2*a* to accurately locate the weft thread W relative to the indexing reed 2*a* and beat-up reed 1*a* (FIG. 13). At this stage of the beat-up operation, the beat-up reed 1*a* has moved to the limit of its downward motion beneath the plane of the warp sheet so as not to interfere with the weft thread W contacting the fingers 2 of the indexing reed 2*a* as the indexing reed is moved to the left toward the weft thread W.

Figure 15:
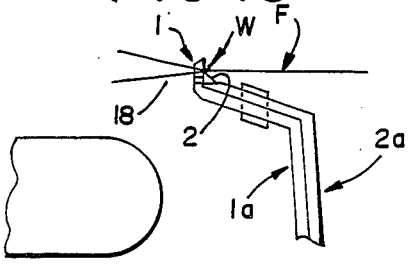

Following the indexing fingers 2 contacting the weft thread W, the beat-up reed 1*a* begins to move upward (FIG. 14) until its fingers 1 once again project through the plane of the warp sheet, at a position just behind the most recently removed weft thread W. At this point of the operation, the spacing between adjacent warp threads is maintained by the wide root sections 10 of the indexing reed 2. The wide root sections 10 of the indexing reed 2 provide a wider spacing between adjacent warp threads to facilitate the insertion of the tips of the fingers 1 of the beat-up reed 1*a* between the same warp threads the fingers 2 of the indexing reed are positioned between. When the fingers 1 of the beat-up reed have been inserted between the warp threads behind the weft thread W, the beat-up of the weft thread begins. As the beat-up fingers 1 move the weft thread W toward the fell F of the fabric, the indexing fingers 2 are concurrently withdrawn from between the warp threads to the position below the plane of the fabric where the indexing reed 2*a* seats on the beat-up reed 1*a* (FIG. 15). The beat-up reed 1*a* and the indexing reed 2*a* then move together toward the fell of the fabric F, pushing the weft thread W toward the fell. In the position of the beat-up reed 1*a* and the indexing reed 2*a* shown in FIG. 10, the beat-up operation is completed. The beat-up reed 1*a* and the indexing reed 2*a* are ready to repeat the sequence of movements to receive the next weft thread to be removed from the shed retainers and beat it into the fell of the fabric.

A suitable driving means for imparting motion to the beat-up reed and the indexing reed is disclosed in the U.S. Pat. No. 4,351,367 which has been incorporated herein by reference. Other driving arrangements may be employed, of course, to drive the beat-up and indexing reeds 1, 2 and the arrangement disclosed in the aforesaid patent is merely exemplary.

In view of the foregoing, it is seen that there has been provided in accordance with the present invention an improved beat-up system that substantially reduces the friction of the beat-up apparatus on the warp threads, and also operates to continuously maintain the spacing between adjacent warp threads while beating up the weft threads into the fell of the fabric. In addition, the wider root sections of the indexing fingers and beat-up fingers operate to increase the spacing between the warp threads, and ensure that the beat-up fingers or the indexing fingers removed from the plane of the warp threads are reinserted into the plane of the warp threads at their proper locations. The guide pin and guide opening system of the present invention also ensure that alignment between the beat-up fingers and indexing fingers of the beat-up and indexing reeds are continuously maintained throughout the beat-up operation. The modular construction of the indexing and beat-up fingers facilitates repair and adjustment of the index and beat-up system. Although a preferred embodiment of the present invention has been disclosed herein, it is not intended that the subject matter should be limited by this disclosure. For example, the present invention may be employed in a loom other than the multi-shed type, and more than the disclosed number of pins and openings may be employed without departing from the scope of the invention.

What is claimed is:

1. A beat-up mechanism for a weaving machine comprising:

an indexing reed having a series of warp thread engaging index fingers arranged in parallel across its width, said index fingers each including a root section and a tip section, said root section having a transverse wider width that the tip section;

a beat-up reed having a series of warp thread engaging beat-up fingers arranged in parallel across its width, said beat-up fingers each including a root section and a tip section, said root section having a transverse wider width than the tip section;

said beat-up reed arranged to cooperate with and move relative to said indexing reed so as to maintain a consistent spacing between warp threads being woven in the weaving machine while beating up weft threads into the fell of the cloth produced by the machine.

2. In a loom for weaving warp thread and weft thread into fabric including:

means for separating wrap threads for different planes to form warp sheds:

means for inserting a weft thread through said warp sheds;

means for advancing said weft thread to a beat up engaging position adjacent a fabric fell and a beat-up including an indexing reed and a beat-up reed, said indexing reed having a plurality of parallel fingers movable into and out of a position between said warp threads to maintain the spacing between said warp threads, the improvement comprising:

said indexing fingers each including a tip and a root section, with the root section having a transverse wider width that the tip section;

said beat-up reed having a plurality of parallel beat-up fingers movable into and out of a position between said warp threads for beating-up an inserted weft thread from beat-up engaging position into the fell of the fabric and maintaining the spacing between said warp threads when said indexing fingers are moved out of a position between said warp threads, said beat-up reed arranged to maintain mutual guiding contact with and being movable relative to said indexing reed.

3. The improvement in a loom as claimed in claim 2 wherein said beat-up fingers each include tip and root sections, with each root sections having a wider transverse width than the tip section.

4. The improvement in a loom as claimed in claim 2 wherein said indexing fingers are arranged to maintain the spacing between said warp threads when said beat-up fingers are in a position to be moved out from between said warp threads.

5. The improvement in a loom as claimed in claim 3 wherein said beat-up fingers are arranged to maintain the spacing between said warp threads when said indexing fingers are in a position to be moved out from between said warp threads.

6. The improvement in a loom as claimed in claim 2 wherein the root sections of said indexing fingers maintain the spacing between said warp threads when the tip sections of said beat-up fingers are in a position to be moved between said warp threads.

7. The improvement in a loom as claimed in claim 3 wherein the root sections of said beat-up fingers are arranged to maintain the spacing between said warp threads when the tips of said indexing fingers are in a position to be moved between said warp threads.

8. The improvement in a loom as claimed in claim 3 wherein the root sections of said index fingers and beat-up fingers are connected with the respective tip sections of said index fingers and beat-up fingers by a transition portion arranged to form a continuous transition connecting the respective surface of the root sections with the surface of the tip sections.

9. The improvement in a loom as claimed in claim 3 wherein the root sections of said indexing and beat-up fingers, upon placement in position between said warp threads, are arranged to provide a greater spacing between said warp threads than the spacing provided when the respective tip sections of said indexing and beat-up fingers are located between said warp threads.

10. In a loom for weaving warp thread and weft thread into fabric including means for separating warp threads into different planes to form warp sheds; means for inserting weft threads through said warp sheds;

means for advancing said weft thread to beat-up engaging positions adjacent the fabric fell; an indexing reed having a base portion with a plurality of parallel fingers extending from said base portion and movable into and out of a position between said warp threads to maintain the spacing between said warp threads; and a beat-up reed in mutual contact with and movable relative to said indexing reed, said beat-up reed having a base portion with a plurality of parallel fingers extending from said base portion and movable into and out of a position between said warp threads to maintain the spacing between said warp threads when said indexing fingers are moved out of a position between said warp threads and for beating-up an inserted weft thread from said beat-up engaging position into the fell of the fabric, the improvement comprising:

guide means arranged to maintain mutual guiding contact between said indexing reed and said beat-up reed when said indexing reed and beat-up reed are moved into and out of position between said warp threads, said guide means including a guide pin means extending from said base portion of either of said indexing reed or beat-up reed and a mating guide opening in the base portion of the other of said indexing reed or beat-up reed, said guide pin and guide opening arranged to cooperate with each other to maintain said indexing reed and beat-up reed aligned with each other during beat-up by the loom.

11. The improvement in a loom as claimed in claim 10 wherein said guide pin means comprises a plurality of projections.

12. The improvement in a loom as claimed in claim 10 wherein said guide pin means includes a plurality of projections which extend from said base portions of both said indexing reed and said beat-up reed.

13. The improvement in a loom as claimed in claim 11 wherein said guide opening includes a plurality of openings cooperating with said projections.

14. The improvement in a loom as claimed in claim 10 wherein said guide openings include a plurality of openings which extend through said base portions of both said indexing reed and said beat-up reed.

15. The improvement in a loom as claimed in claim 12 wherein said plurality of projections are arranged to overlap in a parallel and alternating relationship so that said plurality of overlapping projections maintain mutual contact between said indexing reed and said beat-up reed when said indexing reed and said beat-up reed are moved into and out of position between said warp threads.

16. The improvement in a loom as claimed in claim 15 wherein said indexing reed and said beat-up reed are arranged to be moved away from each other during the beat-up cycle of the loom to the extent that the guide pin means do not engage the guide openings, wherein said plurality of projections are arranged so as to maintain mutual contact between themselves so as to maintain said indexing reed and said beat-up reed in alignment when said indexing reed and said beat-up reed are moved away from each other with the guide pin means disengaged from the guide openings.

17. The improvement in a loom as claimed in claim 16 wherein said plurality of projections each have a rectangular cross-section, and opposing sides of alternate overlapping projections maintain mutual contact when said indexing reed and said beat-up reed are moved away from each other with the guide pin means disengage from the guide openings.

18. The improvement in a loom as claimed in claim 13, wherein said projections and openings respectively extend from and through both the indexing and beat-up reeds, and are arranged to cooperate with each other such that a single projection extends from either the indexing or beat-up reed between and contiguous with a pair of projections extending from the other of the indexing and beat-up reeds, with each projection engageable with a respective opening in the adjacent reed.

19. In a beat-up mechanism for a weaving machine including a beat-up reed extending across the loom width including weft engaging beat-up fingers and beat-up motion imparting means for the beat-up reed, the improvement comprising:

said beat-up reed including multiple groups of beat-up fingers supported by multiple modular support means, each having a width less than the width of the beat-up reed; and said modular support means each attached to said means for imparting motion by releasable fastener means, whereby said beat-up reed comprises multiple modular support means that can be individually removed from the beat-up reed and replaced when worn or damaged;

an indexing reed having a plurality of groups of weft engaging indexing fingers, said beat-up reed and indexing reed arranged to maintain mutual guiding contact with each other during weft beat-up;

said groups of indexing fingers supported by multiple modular indexing finger support elements, each having a width less than the width of the indexing reed;

means for imparting motion to the indexing reed so that it maintains contact with the beat-up fingers;

said modular indexing finger support elements attached to said means for imparting motion to the indexing reed by releasable fastener means whereby said indexing reed comprises multiple modular support means that can be individually removed from the indexing reed and replaced when worn or damaged.

* * * * *

UNITED STATES PATENT AND TRADEMARK OFFICE

CERTIFICATE OF CORRECTION

PATENT NO. : 4,887,650

DATED : Dec. 19, 1989

INVENTOR(S) : Thomas F. McGinley

It is certified that error appears in the above-identified patent and that said Letters Patent is hereby corrected as shown below:

IN THE SPECIFICATION:

Column 1, line 9, before "weft" insert -- a --.
Column 4, line 56, delete "section" and insert -- sections --.
Column 4, line 60, delete "an" and insert -- can --.
Column 6, line 28, delete "moves" and insert -- move --.

IN THE CLAIMS:

Claim 1 - Column 7, line 57, delete "that" and insert -- than --.
Claim 2 - Column 8, line 3, delete "for" and insert -- into --. (2nd occurrence)
Claim 2 - Column 8, line 16, delete "that" and insert --than--.
Claim 3 - Column 8, line 29, delete "sections" and insert --section--. (2nd occurrence)

Signed and Sealed this

Twenty-sixth Day of February, 1991

*Attest:*

HARRY F. MANBECK, JR.

*Attesting Officer*

*Commissioner of Patents and Trademarks*